US011798751B2

(12) United States Patent
Hernandez Maya et al.

(10) Patent No.: US 11,798,751 B2
(45) Date of Patent: Oct. 24, 2023

(54) METAL CONTACT OF A RESIDENTIAL CIRCUIT BREAKER INCLUDING ORDERED CERAMIC MICROPARTICLES

(71) Applicant: Siemens Industry, Inc., Alpharetta, GA (US)

(72) Inventors: Roberto Carlos Hernandez Maya, Garcia (MX); Luis Miguel Franco Caballero, Monterrey (MX); Francisco Franco Caballero, Monterrey (MX)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 17/363,126

(22) Filed: Jun. 30, 2021

(65) Prior Publication Data

US 2023/0005673 A1 Jan. 5, 2023

(51) Int. Cl.

| | |
|---|---|
| ***H01H 1/025*** | (2006.01) |
| ***C22C 9/00*** | (2006.01) |
| ***C22C 29/00*** | (2006.01) |
| ***C22C 29/08*** | (2006.01) |

(52) U.S. Cl.

CPC ..... *H01H 1/025* (2013.01); *C22C 9/00* (2013.01); *C22C 29/005* (2013.01); *C22C 29/08* (2013.01)

(58) Field of Classification Search

None

See application file for complete search history.

(56) References Cited

U.S. PATENT DOCUMENTS

| | | | | |
|---|---|---|---|---|
| 2,768,099 A * | 10/1956 | Hoyer | H01H 1/0233 | 427/125 |
| 4,299,889 A * | 11/1981 | Kato | H01H 1/0203 | 428/568 |
| 4,919,717 A * | 4/1990 | Ambier | C22C 1/0425 | 75/243 |
| 2006/0096846 A1* | 5/2006 | Rival | H01H 1/027 | 218/108 |

FOREIGN PATENT DOCUMENTS

JP 2003155530 A * 5/2003

* cited by examiner

*Primary Examiner* — Humera N. Sheikh
*Assistant Examiner* — Kim S. Horger

(57) ABSTRACT

A metal contact of a residential circuit breaker with ordered ceramic microparticles is provided. The metal contact comprises an electrical contact material comprising a metal alloy and ceramic particles to form a metal matrix composite material. Both materials the metal alloy and the ceramic particles are present together as a metal compound but without forming an alloy. The metal compound is a matrix and reinforcement being the ceramic particles such that first the ceramic particles has a sintering step to get a homogeneous preform for the metal compound being porous with a controlled size obtained by pressing a particle size of about few micrometers of the ceramic particles and then a liquid metal infiltration step to provide a homogenous distribution of the metal alloy and the ceramic particles in a three-dimensional open porous arrangement and the homogenous distribution results in ordered microstructures.

10 Claims, 7 Drawing Sheets

METAL CONTACT OF A RESIDENTIAL CIRCUIT BREAKER INCLUDING ORDERED CERAMIC MICROPARTICLES

BACKGROUND

1. Field

Aspects of the present invention generally relate to a metal contact of a residential circuit breaker that includes ordered ceramic microparticles.

2. Description of the Related Art

Noble metals for metal contacts have been the common material to build residential circuit breakers over years and silver (Ag) is the preferred material for this purpose but this type of metal contacts have some performance issues due to their chemistry/nature. For example, it has a high tendency to suffer from: soldering between contacts because of its low melting point, increasing of the presence of sub-products between the contacts, reducing of the effective contact area and finally increasing of the temperature of a circuit.

Until now, to solve the issues emerging from the use of noble metals and its application for metal contacts, like using Ag, is by incorporation of some compounds to reduce this tendency to the soldering, and the most common types of alloys applied for metal contacts include: Ag—Ni, Ag—SnO2, Ag—CdO, Ag—W, Ag—C, Cu—W, Ag—WC, Ag—WC/C. However, this type of alloys still has some technical disadvantages, like the low wear resistance, which could increase the contact resistance and cause the breaker to test more nonconformances. Besides these technical issues, the high cost of Ag represents other issue in this type of metal contacts for the construction of circuit breakers.

Therefore, there is a need for a better metal contact of a circuit breaker for a residential application.

SUMMARY

Briefly described, aspects of the present invention relate to a metal contact of an electronic circuit breaker for a residential application that includes ordered ceramic microparticles. This ceramic content has a highlighted impact in electrical conductivity and hardness. The change of the used alloy for metal contacts, by one with a better wear resistance, hardness and with good electrical conductivity is a solution to decrease the price of the circuit breaker and extend the service life of it. The use of a different alloy based in Ag-free materials with a better wear resistance helps to reduce the issues related with the metal contacts as this material has the characteristic to be conductive and at the same time it has better or similar corrosion resistance. With the mentioned alloy and the ordered distribution of the ceramic microparticles, one can obtain metal contacts with competitive properties in comparison with the Ag contacts. In weight proportions for metal/ceramic particle combination the metal contents are 30 to 50 wt. %, whereas the balance belongs to the ceramic particle content. With the use of a proposed combination of alloy/ceramic properties and with the control in the size of the latter, one can obtain a material with similar properties as offered by the Ag contacts but cheaper. Specifically, in the case of miniature circuit breakers (MCBs), the price reduction is around 15% against the price of Ag contact.

In accordance with one illustrative embodiment of the present invention, a metal contact of a residential circuit breaker is provided. The metal contact comprises an electrical contact material comprising a metal alloy and ceramic particles to form a metal matrix composite material. Both materials the metal alloy and the ceramic particles are present together as a metal compound but without forming an alloy. The metal compound is a matrix and reinforcement being the ceramic particles such that first the ceramic particles has a sintering step to get a homogeneous preform for the metal compound being porous with a controlled size obtained by pressing a particle size of about few micrometers of the ceramic particles and then a liquid metal infiltration step to provide a homogenous distribution of the metal alloy and the ceramic particles in a three-dimensional open porous arrangement and the homogenous distribution results in ordered microstructures.

In accordance with one illustrative embodiment of the present invention, a circuit breaker comprises a metal contact. The metal contact includes an electrical contact material comprising a metal alloy and ceramic particles to form a metal matrix composite material. Both materials the metal alloy and the ceramic particles are present together as a metal compound but without forming an alloy. The metal compound is a matrix and reinforcement being the ceramic particles such that first the ceramic particles has a sintering step to get a homogeneous preform for the metal compound being porous with a controlled size obtained by pressing a particle size of about few micrometers of the ceramic particles and then a liquid metal infiltration step to provide a homogenous distribution of the metal alloy and the ceramic particles in a three-dimensional open porous arrangement and the homogenous distribution results in ordered microstructures.

In accordance with one illustrative embodiment of the present invention, a method of providing a metal contact of a circuit breaker. The method comprises providing an electrical contact material comprising a metal alloy and ceramic particles to form a metal matrix composite material. The method further comprises pressing of the ceramic particles of a particle size of about 2 micrometers. The method further comprises obtaining a homogeneous preform for a metal compound being porous with a controlled size by sintering of the ceramic particles. The method further comprises providing a homogenous distribution of the metal alloy and the ceramic particles in a three-dimensional open porous arrangement such that the homogenous distribution results in ordered microstructures.

DETAILED DESCRIPTION

Figure 1:
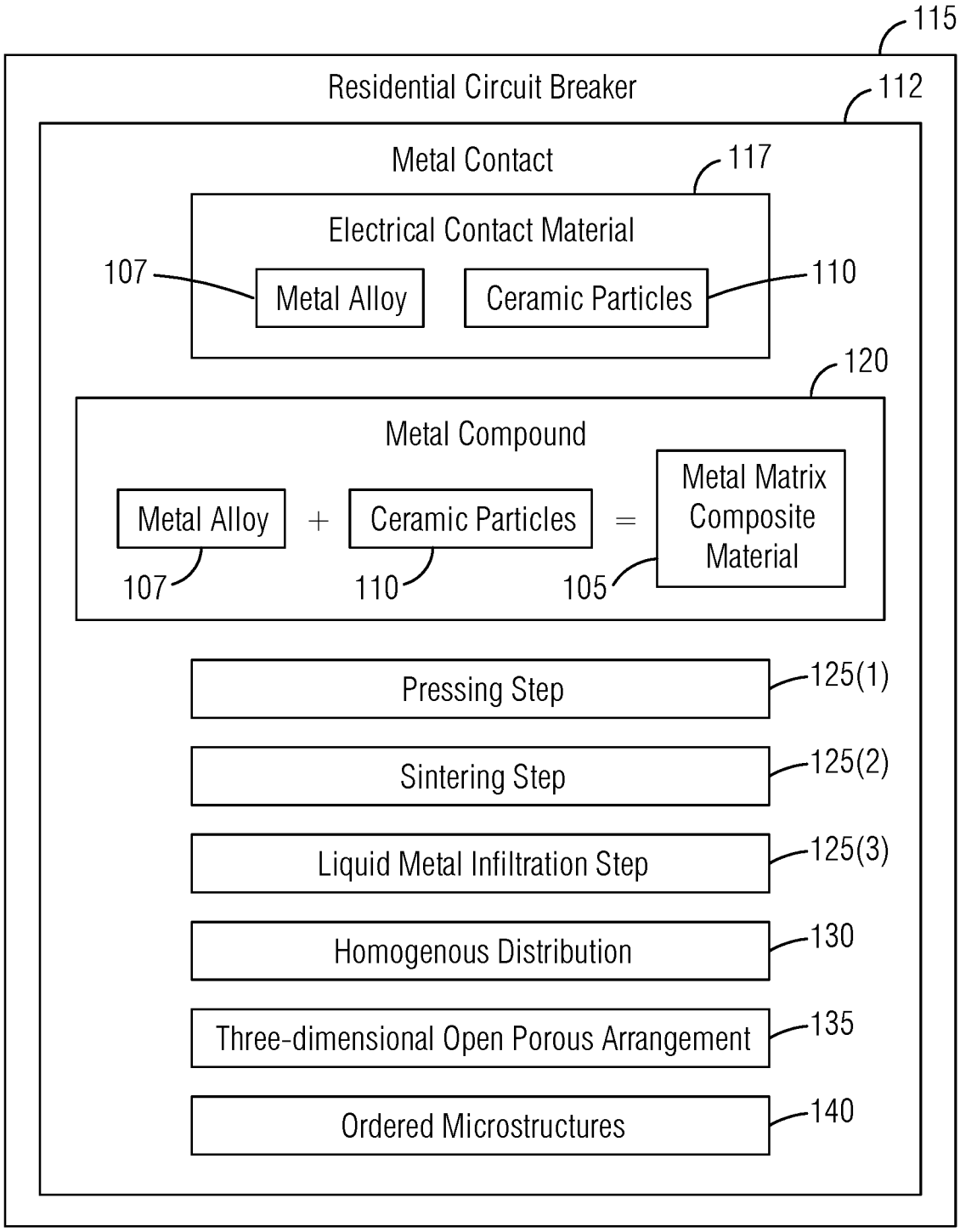
FIG. 1 illustrates a metal matrix composite material formed by a metal alloy and ceramic particles for a metal contact of a residential circuit breaker in accordance with an exemplary embodiment of the present invention.

To facilitate an understanding of embodiments, principles, and features of the present invention, they are explained hereinafter with reference to implementation in illustrative embodiments. In particular, they are described in the context of a metal contact of a residential circuit breaker that includes ordered ceramic microparticles. This invention provides the use of ordered microparticles structures to improve the performance of the metal contacts in combination with the use of Ag-free materials. Until now, the use of expensive materials, like Ag, is the best way to make front of the metal contacts. Cu alloy contacts offer price reduction and such contacts could be a very good candidate to replace the Ag or Ag alloy contacts used in the construction of current residential circuit breakers. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

These and other embodiments of the circuit breaker according to the present disclosure are described below with reference to FIGS. 1-15 herein. Like reference numerals used in the drawings identify similar or identical elements throughout the several views. The drawings are not necessarily drawn to scale.

Consistent with one embodiment of the present invention, FIG. 1 represents a metal matrix composite material 105 formed by a metal alloy 107 and ceramic particles 110 for a metal contact 112 of a residential circuit breaker 115 in accordance with an exemplary embodiment of the present invention. The metal contact 112 of the residential circuit breaker 115 comprises an electrical contact material 117 comprising the metal alloy 107 and the ceramic particles 110. Both materials the metal alloy 107 and the ceramic particles 110 are present together as a metal compound 120 but without forming an alloy. The metal compound 120 is a matrix and reinforcement being the ceramic particles 110 such that first the ceramic particles 110 has a sintering step 125(2) to get a homogeneous preform for the metal compound 120 being porous with a controlled size obtained by pressing 125(1) a particle size of about 2 micrometers of the ceramic particles 110 and then a liquid metal infiltration step 125(3) to provide a homogenous distribution 130 of the metal alloy 107 and the ceramic particles 110 in a three-dimensional open porous arrangement 135 and the homogenous distribution 130 results in ordered microstructures 140.

In one embodiment, the ceramic particles 110 are tungsten carbide (WC) and the metal alloy 107 is copper alloy (Cu alloy). The particle size of the ceramic particles 110 is about 2 micrometers. The copper alloy (Cu alloy) is formed with addition of relatively small amounts of Ag and Ni as follows, $Cu—Ag_X—Ni_Y$ (where X=1 to 4 wt % and Y=0.5 to 1.5 wt %). In weight proportions of the metal alloy/ceramic particles, the metal alloy 107 content may be about 30 to 50 wt %. For example, weight proportions may be 30 wt % the metal alloy 107 as a conductor metal and 70 wt % the ceramic particles 110. $Cu—Ag_X—Ni_Y$ is an Ag-free alloy as Ag is missing as the main metal while Ag is acting only as a alloying element.

As noted above, before the sintering step 125(2) the pressing step 125(1) of the ceramic particles 110 is done. The liquid metal infiltration step 125(3) will take place by filling the metal compound 120 being porous by metal to obtain the metal matrix composite material 105. By using the ordered microstructures, the superficial properties of the metal alloy 107 are balanced like electrical conductivity and wear resistance thus allowing the metal matrix composite material 105 to have similar performance in comparison with silver (Ag) contacts. With control on the particle size, a general distribution is more homogeneous thus providing the homogeneous distribution 130 of a surface's mechanical properties.

Figure 2:
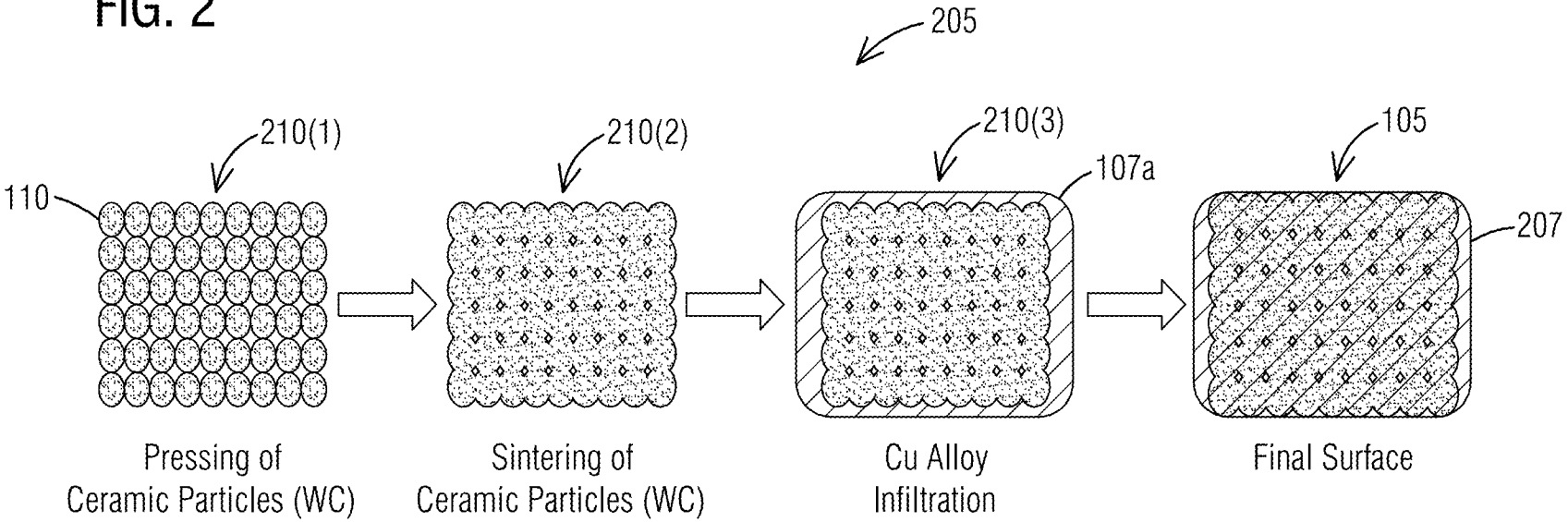
FIG. 2 illustrates a general processing method to obtain a metal contact in accordance with an exemplary embodiment of the present invention.

Referring to FIG. 2, it illustrates a general processing method 205 to obtain a metal contact 207 in accordance with an exemplary embodiment of the present invention. The process to obtain a functional material for metal contacts purpose, in general term, involve three main steps 210(1-3). A general diagram of the mentioned steps is showed in FIG. 2.

Processing of the metal contact 207 for a circuit breaker application includes a pressing step 210(1) of pressing the ceramic particles 110 and a sintering step 210(2) of sintering the ceramic particles 110 and a liquid metal infiltration step 210(3). The general processing method 205 to obtain the metal contact 207 is normally divided in three different steps, where the result is a material with a synergic combination of the properties of each compound. It will provide an improved material, but without an alloy formed between them. The control of ceramic particle size at 2 μm, will allow to control the sintering step 210(2), leaving it porous with a controlled size and distribution as an ordered structure. The liquid metal infiltration step 210(3) will take place next, filling this porous structure by metal to obtain the metal matrix composite material 105 with a homogeneous distribution of two main compounds, metal like Cu alloy, and the ceramic particles, like tungsten carbide. This homogenous distribution will result in an ordered with homogeneous properties distribution.

Here is the more detailed information for the above mentioned three steps. In the pressing step 210(1), the ceramic particles 110 are pressed to obtain a preform of the microceramic particles such that a precise control in the size of these ceramic particles is required to generate an ordered microceramic structure. The sintering step 210(2) is executed at high temperatures but below the melting point of the ceramic particles where the binder will be out gassed, leaving an ordered structure with a three-dimensional open porous arrangement which will be filled by a liquid metal. In liquid metal infiltration step, the ordered microceramic structure is heated at high temperature to avoid the fast solidification of the liquid metal. Once it reaches a homogeneous temperature, the liquid metal is infiltrated into the ordered structure under a constant pressure and controlled environment to fill out the three-dimensional open porous arrangement.

The ceramic particles of tungsten carbide (WC) have a controlled size of 2 μm. The used Cu alloy 107*a* for the last step is the key for this type of metal contact. In this case, the metal matrix composite material 105 was developed using a Cu alloy, which was formed with the addition of small amounts of Ag and Ni as follows, $Cu—Ag_X—Ni_Y$ (where X=1 to 4 wt % and Y=0.5 to 1.5 wt %). With the Cu alloy 107*a* and the ordered distribution of the ceramic microparticles, one can obtain metal contacts with competitive properties in comparison with the Ag contacts. In weight proportions, the metal alloy/ceramic particles combination may have metal alloy contents at 30 to 50 wt % whereas the balance belongs to the ceramic particles 110 content. With the use of this proposed combination of alloy/ceramic properties, and with the control in the size of the last one, one can obtain a material with similar properties as offered by the Ag contacts, but with the advantage of the proposed one is cheaper in cost. Specifically, in the case of MCB's breakers, the price reduction is around 15% against the price of Ag contact, which is currently in use.

Figure 3:
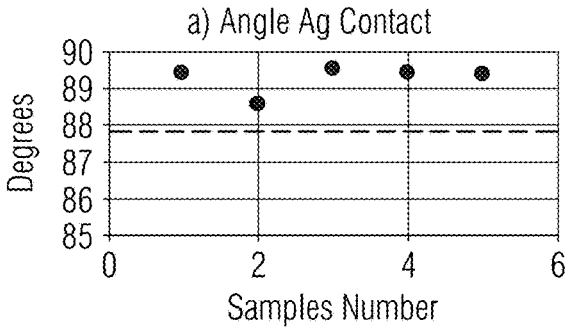
FIG. 3 illustrates the angle results for Ag contacts obtained from a shear test applied into the Cu contacts in comparison with the Ag contacts in accordance with an exemplary embodiment of the present invention.
Figure 4:
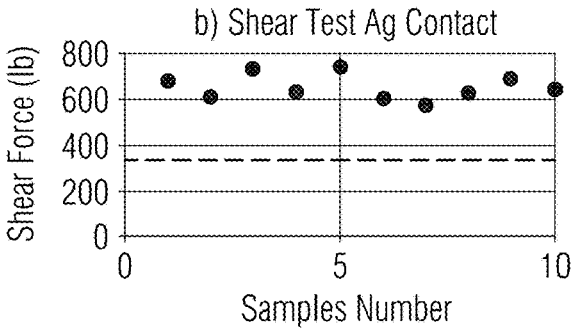
FIG. 4 illustrates the shear results for Ag contacts obtained from a shear test applied into the Cu contacts in comparison with the Ag contacts in accordance with an exemplary embodiment of the present invention.

Turning now to FIG. 3, it illustrates the angle results for Ag contacts obtained from a shear test applied into the Cu contacts in comparison with the Ag contacts in accordance with an exemplary embodiment of the present invention. FIG. 4 illustrates the shear results for Ag contacts obtained from a shear test applied into the Cu contacts in comparison with the Ag contacts in accordance with an exemplary embodiment of the present invention.

Figure 5:
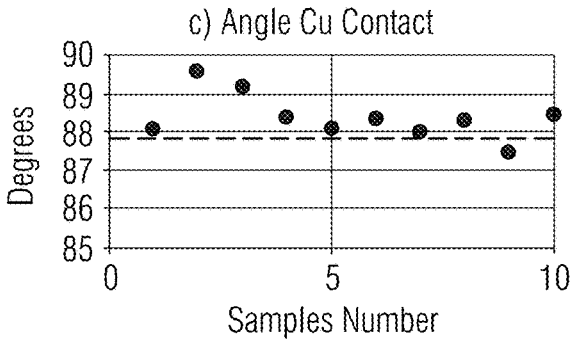
FIG. 5 illustrates the angle results for Cu contacts obtained from a shear test applied into the Cu contacts in comparison with the Ag contacts in accordance with an exemplary embodiment of the present invention.
Figure 6:
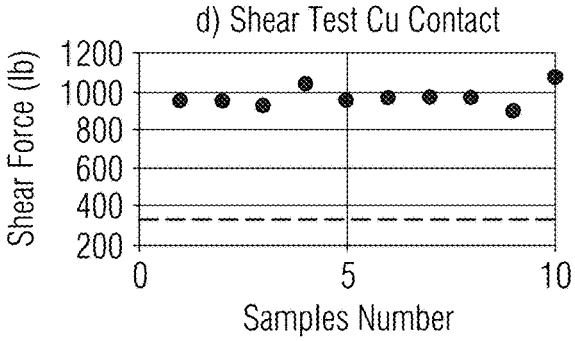
FIG. 6 illustrates the shear results for Cu contacts obtained from a shear test applied into the Cu contacts in comparison with the Ag contacts in accordance with an exemplary embodiment of the present invention.

As seen in FIG. 5, it illustrates the angle results for Cu contacts obtained from a shear test applied into the Cu contacts in comparison with the Ag contacts in accordance with an exemplary embodiment of the present invention. As shown in FIG. 6, it illustrates the shear results for Cu contacts obtained from a shear test applied into the Cu contacts in comparison with the Ag contacts in accordance with an exemplary embodiment of the present invention.

In this case, the showed results belong to a metal contact made of a metal alloy/ceramic microparticles combination split at 30-70 wt %. The validation of performance was measured by different type of tests like a shear test, a temperature rise test and validated it with microstructural characterization. In FIGS. 3-6 it is possible to observe the obtained results during a shear test in comparison against the Ag contacts. In FIGS. 3-6, it is possible to observe how the general performance of the proposed contacts on this test is better than the Ag contacts in view of the specs which applies to Ag contacts inside a factory.

Figure 7:
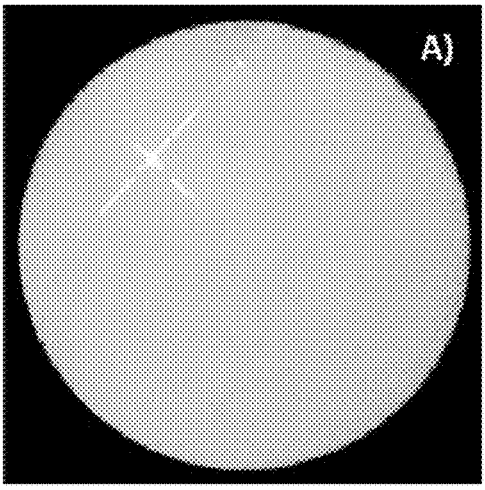
FIG. 7 illustrates a view of an Ag contact at 50× magnification to determine the ordered distribution in accordance with an exemplary embodiment of the present invention.
Figure 8:
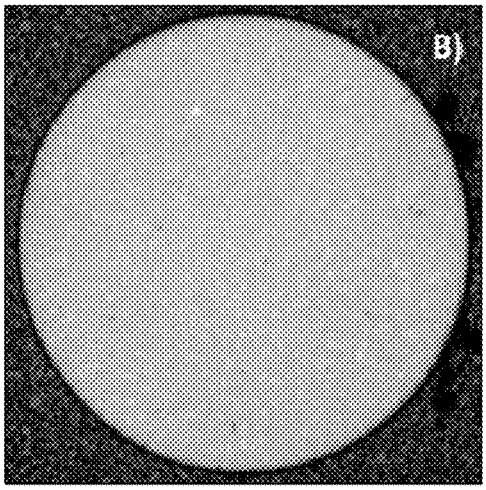
FIG. 8 illustrates a view of a Cu contact at 50× magnification to determine the ordered distribution in accordance with an exemplary embodiment of the present invention.

In FIG. 7, it illustrates a view of an Ag contact at 50× magnification to determine the ordered distribution in accordance with an exemplary embodiment of the present invention. With regard to FIG. 8, it illustrates a view of a Cu contact at 50× magnification to determine the ordered distribution in accordance with an exemplary embodiment of the present invention.

Figure 9:
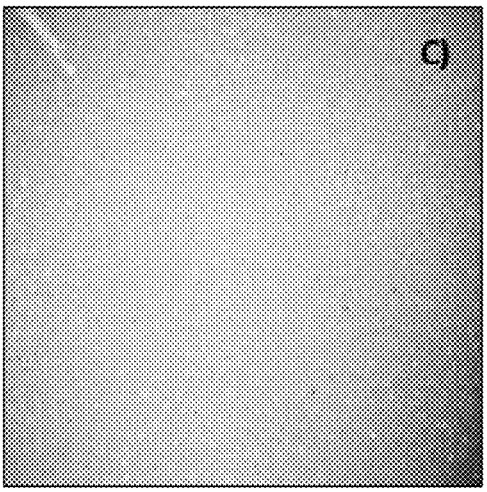
FIG. 9 illustrates a view of an Ag contact at 100× magnification to determine the ordered distribution in accordance with an exemplary embodiment of the present invention.
Figure 10:
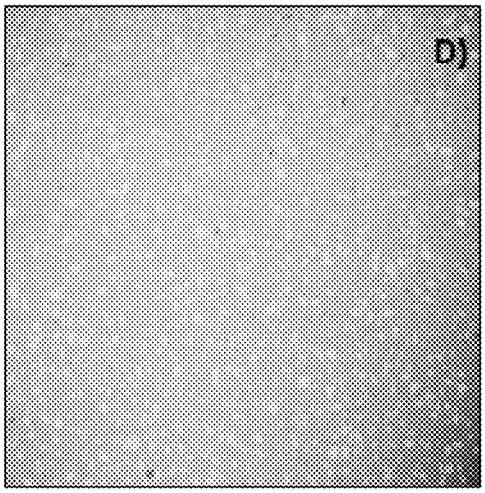
FIG. 10 illustrates a view of a Cu contact at 100× magnification to determine the ordered distribution in accordance with an exemplary embodiment of the present invention.

With respect to FIG. 9, it illustrates a view of an Ag contact at 50× magnification to determine the ordered distribution in accordance with an exemplary embodiment of the present invention. FIG. 10 illustrates a view of a Cu contact at 50× magnification to determine the ordered distribution in accordance with an exemplary embodiment of the present invention.

By using ordered structures in the conformation of metal contacts one can balance the superficial properties of the metal contacts like electrical conductivity and wear resistance, allowing the material to have similar performance in comparison with the Ag contacts. In FIGS. 7-10, it is possible to observe the result by controlling the distribution of the ceramic particles in an analysis via an optical microscope at different magnifications.

As we can see in FIGS. 7-10, the ordered distribution was determined with an optical microscope at 50× and 100× magnification and it is evident how the ordered distribution could affect the surface distribution of the conductive metal. The Ag contacts without a particle size control of the ceramic particles shows areas without conductive metal (whit spots) and others with cluster or agglomeration of it. In opposite way, with control on the particle size the general distribution looks more homogeneous for Cu contact which should result in a homogeneous distribution of the surface mechanical properties. The impact of this ordered distribution could be corroborated with the performance of the metal matrix composite material 105 installed in the residential circuit breaker 115 where it was tested under the conditions required for the temperature rise test.

Figure 11:
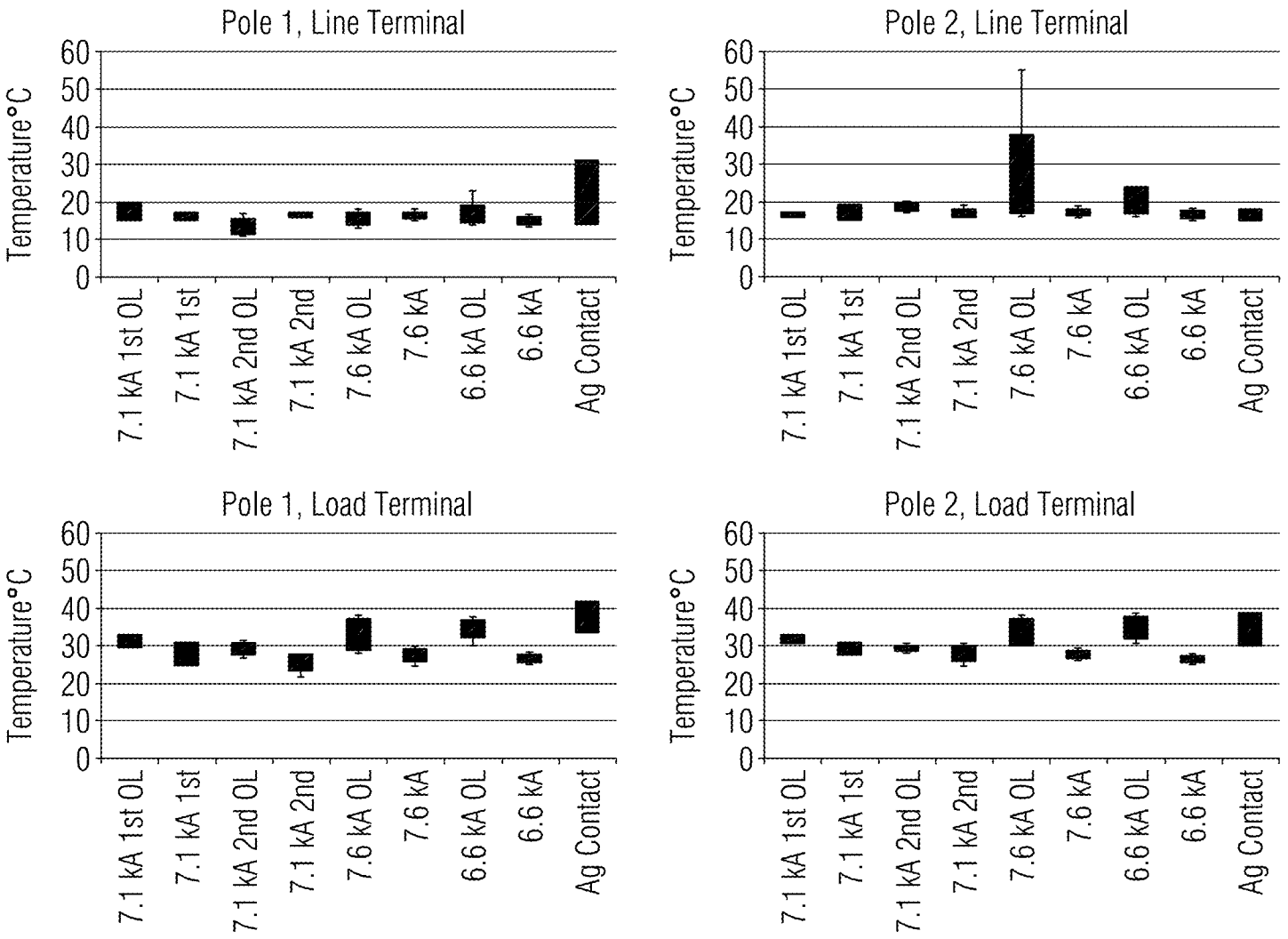
FIG. 11 illustrates performance of the Cu contacts vs. Ag contacts into a residential breaker under the conditions required for a temperature rise test in accordance with an exemplary embodiment of the present invention.

FIG. 11 illustrates performance of the Cu contacts vs. Ag contacts into a residential circuit breaker under the conditions required for a temperature rise test in accordance with an exemplary embodiment of the present invention. In addition to the above-mentioned advantages of this type of material in residential circuit breakers such as cost savings and shear test performances further its performance under a more specific test called the temperature rise test is presented. FIG. 11 shows the performance in comparison with the Ag contact materials. The graphs show the behavior of the proposed material being installed in a residential circuit breaker against the Ag contacts. The shown performances exhibit good trend in terms of the temperature with small effects due to the change in the applied current during the brazing process but in general term the trend is lighter being more "cooler" than the one observed in the Ag contacts. This point could be related with the ordered and homogeneous distribution of the Cu alloy in the ceramic skeleton during a metal contact manufacture process and for the properties obtained with the metal matrix composite material 105. According with the above results, the potential price reduction in the Cu alloy contacts makes them a very good candidate to replace the Ag contacts used in the construction of current residential circuit breakers.

Figure 12:
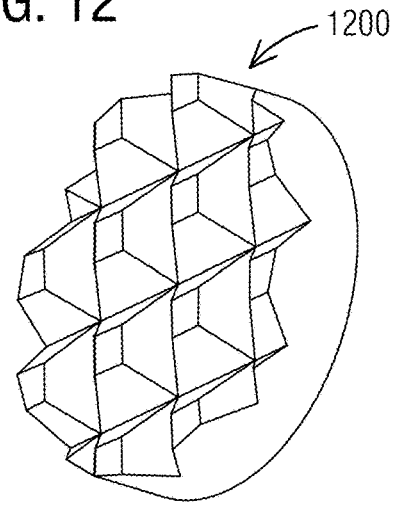
FIG. 12 illustrates a side view of a metal contact in accordance with an exemplary embodiment of the present invention.
Figure 13:
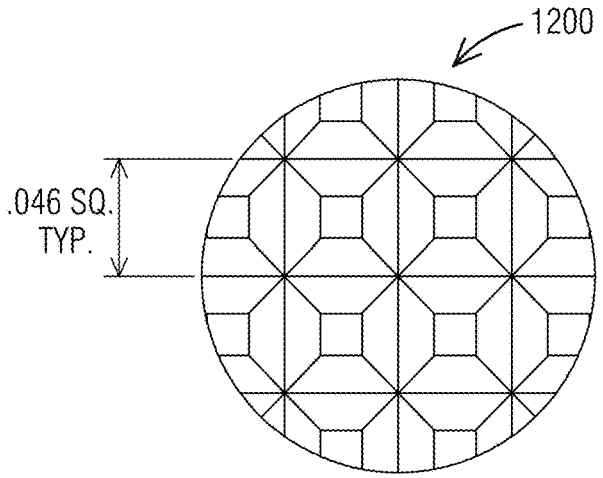
FIG. 13 illustrates a back view of the metal contact of FIG. 12 in accordance with an exemplary embodiment of the present invention.

FIG. 12 illustrates a side view of a metal contact 1200 in accordance with an exemplary embodiment of the present invention. FIG. 13 illustrates a back view of the metal contact 1200 of FIG. 12 in accordance with an exemplary embodiment of the present invention.

Figure 14:
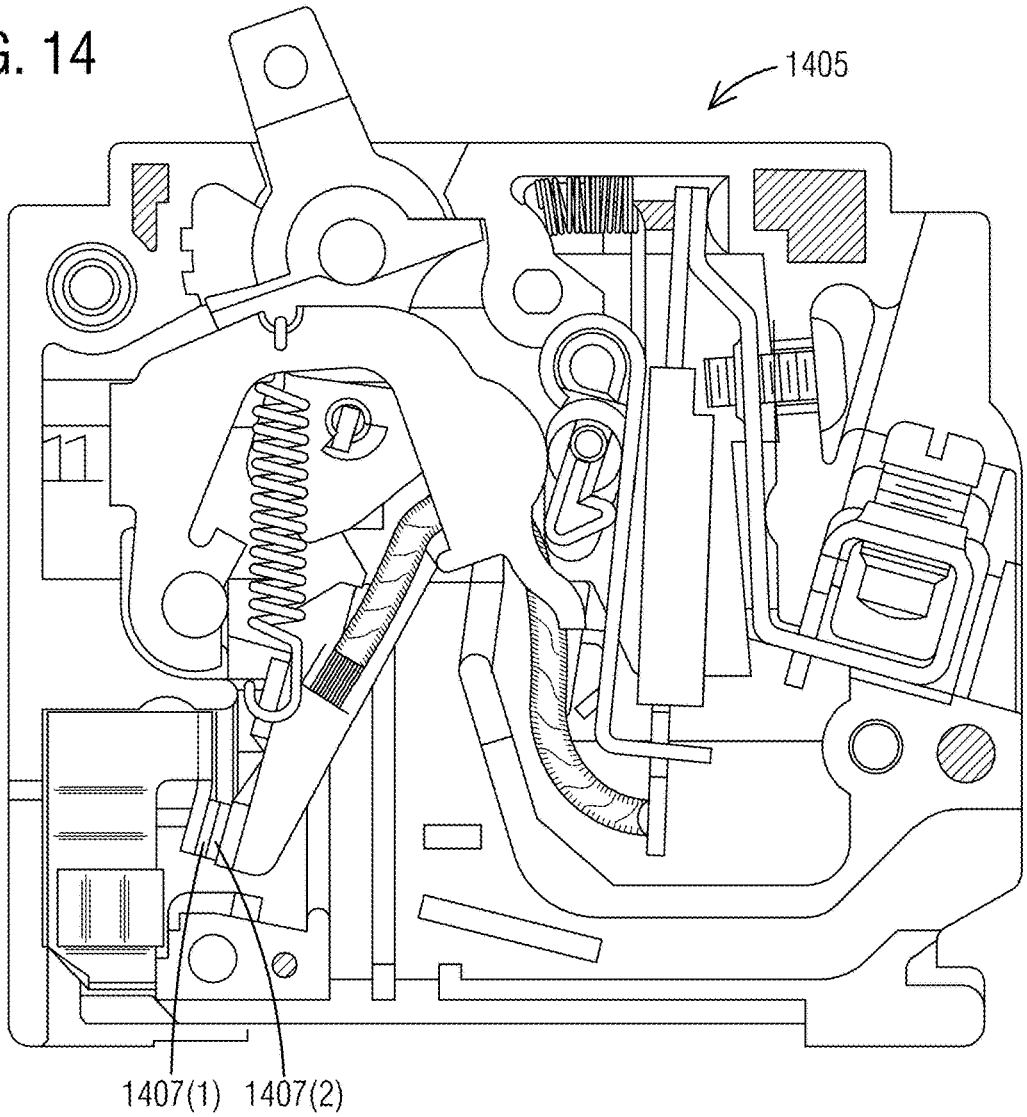
FIG. 14 illustrates a view of a circuit breaker in accordance with an exemplary embodiment of the present invention.

FIG. 14 illustrates a view of a circuit breaker 1405 in accordance with an exemplary embodiment of the present invention. The circuit breaker 1405 comprises a first contact tip 1407(1) comprising a first electrical contact material comprising a metal alloy and ceramic particles which are additively mixed to form a first metal matrix composite material. The circuit breaker 1405 further comprises a second contact tip 1407(2) comprising the metal alloy and the ceramic particles which are additively mixed to form a second metal matrix composite material.

Figure 15:
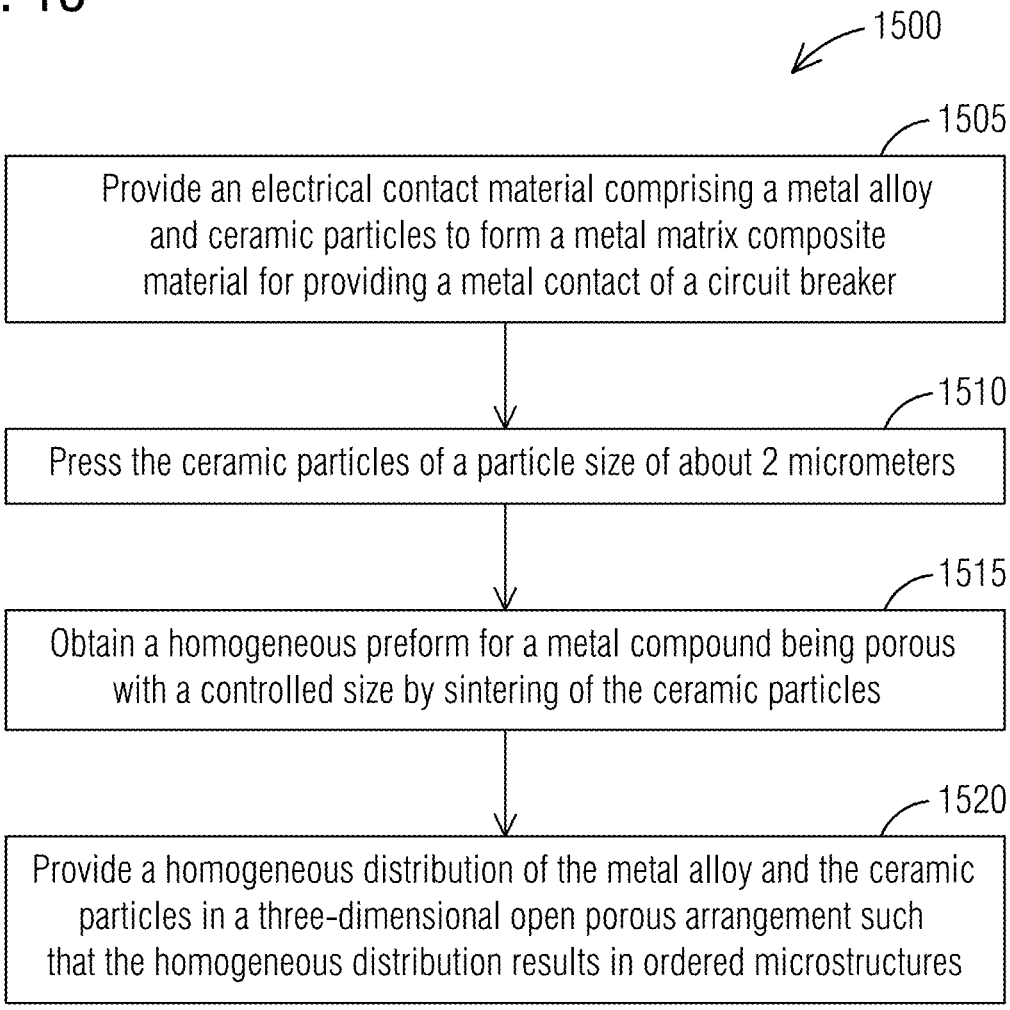
FIG. 15 illustrates a schematic view of a flow chart of a method of providing a metal contact of a circuit breaker in accordance with an exemplary embodiment of the present invention.

FIG. 15 illustrates a schematic view of a flow chart of a method 1500 of providing a metal contact of a circuit breaker in accordance with an exemplary embodiment of the present invention. Reference is made to the elements and features described in FIGS. 1-14. It should be appreciated that some steps are not required to be performed in any particular order, and that some steps are optional.

The method 1500 comprises a step 1505 of providing an electrical contact material comprising a metal alloy and ceramic particles to form a metal matrix composite material. The method 1500 further comprises a step 1510 of pressing of the ceramic particles of a particle size of about 2 micrometers. The method 1500 further comprises a step 1515 of obtaining a homogeneous preform for a metal compound being porous with a controlled size by sintering of the ceramic particles. The method 1500 further comprises a step 1520 of providing a homogenous distribution of the metal alloy and the ceramic particles in a three-dimensional open porous arrangement such that the homogenous distribution results in ordered microstructures.

While a Cu metal alloy is described here a range of one or more other metal alloys are also contemplated by the present invention. For example, other metal-based alloys such as Cd alloy, Sn alloy, and Ni alloy may be implemented based on one or more features presented above without deviating from the spirit of the present invention.

The techniques described herein can be particularly useful for ceramic particles of tungsten carbide (WC). While particular embodiments are described in terms of the ceramic particles of tungsten carbide (WC), the techniques described herein are not limited to such tungsten carbide (WC) but can also be used with other ceramic materials.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

Embodiments and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure embodiments in detail. It should be understood, however, that the detailed description and the specific examples, while indicating preferred embodiments, are given by way of illustration only and not by way of limitation. Various substitutions, modifications, additions and/or rearrangements within the spirit and/or scope of the underlying inventive concept will become apparent to those skilled in the art from this disclosure.

As used herein, the terms "comprises," "comprising," "includes," "including," "has," "having" or any other variation thereof, are intended to cover a non-exclusive inclusion. For example, a process, article, or apparatus that comprises a list of elements is not necessarily limited to only those elements but may include other elements not expressly listed or inherent to such process, article, or apparatus.

Additionally, any examples or illustrations given herein are not to be regarded in any way as restrictions on, limits to, or express definitions of, any term or terms with which they are utilized. Instead, these examples or illustrations are to be regarded as being described with respect to one particular embodiment and as illustrative only. Those of ordinary skill in the art will appreciate that any term or terms with which these examples or illustrations are utilized will encompass other embodiments which may or may not be given therewith or elsewhere in the specification and all such embodiments are intended to be included within the scope of that term or terms.

In the foregoing specification, the invention has been described with reference to specific embodiments. However, one of ordinary skill in the art appreciates that various modifications and changes can be made without departing from the scope of the invention. Accordingly, the specification and figures are to be regarded in an illustrative rather than a restrictive sense, and all such modifications are intended to be included within the scope of invention.

Although the invention has been described with respect to specific embodiments thereof, these embodiments are merely illustrative, and not restrictive of the invention. The description herein of illustrated embodiments of the invention is not intended to be exhaustive or to limit the invention to the precise forms disclosed herein (and in particular, the inclusion of any particular embodiment, feature or function is not intended to limit the scope of the invention to such embodiment, feature or function). Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Respective appearances of the phrases "in one embodiment," "in an embodiment," or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

It will also be appreciated that one or more of the elements depicted in the drawings/figures can also be implemented in a more separated or integrated manner, or even removed or rendered as inoperable in certain cases, as is useful in accordance with a particular application.

Benefits, other advantages, and solutions to problems have been described above with regard to specific embodiments. However, the benefits, advantages, solutions to problems, and any component(s) that may cause any benefit, advantage, or solution to occur or become more pronounced are not to be construed as a critical, required, or essential feature or component.

What is claimed is:

1. A metal contact of a residential circuit breaker, the metal contact comprising:

an electrical contact material comprising a metal alloy and ceramic particles to form a metal matrix composite material, wherein both materials the metal alloy and the ceramic particles are present together as a metal compound but without forming an alloy, wherein the metal compound is a matrix and reinforcement being the ceramic particles such that first the ceramic particles has a sintering step to get a homogeneous preform for the metal compound being porous with a controlled size obtained by pressing a particle size of about 2 micrometers of the ceramic particles and then a liquid metal infiltration step to provide a homogenous distribution of the metal alloy and the ceramic particles in a three-dimensional open porous arrangement and the homogenous distribution results in ordered microstructures, wherein the three-dimensional open porous arrangement is provided by the pressed and sintered ceramic particles prior to infiltrating with liquid metal, and wherein the metal alloy is copper alloy (Cu alloy) which is formed with addition of relatively small amounts of Ag and Ni as follows, $Cu—Ag_X—Ni_Y$ where X=1 to 4 wt % and Y=0.5 to 1.5 wt %.

2. The metal contact of claim 1, wherein the ceramic particles are tungsten carbide (WC).

3. The metal contact of claim 1, wherein before the sintering step pressing of the ceramic particles is done.

4. The metal contact of claim 1, wherein 30 wt % of metal alloy is a conductor metal and 70 wt % is the ceramic particles.

5. The metal contact of claim 1, wherein when considering weight proportions of the metal alloy/ceramic particles the metal alloy portion contents are 30 to 50 wt %.

6. The metal contact of claim 1, wherein with control on the particle size a general distribution is homogeneous thus providing the homogeneous distribution of a metal contact surface's mechanical properties.

7. A circuit breaker, comprising:

a metal contact including:

an electrical contact material comprising a metal alloy and ceramic particles to form a metal matrix composite material, wherein both materials the metal alloy and the ceramic particles are present together as a metal compound but without forming an alloy, wherein the metal compound is a matrix and reinforcement being the ceramic particles such that first the ceramic particles has a sintering step to get a homogeneous preform for the metal compound being porous with a controlled size obtained by pressing a particle size of about 2 micrometers of the ceramic particles and then a liquid metal infiltration step to provide a homogenous distribution of the metal alloy and the ceramic particles in a three-dimensional open porous arrangement and the homogenous distribution results in ordered microstructures, wherein the three-dimensional open porous arrangement is provided by the pressed and sintered ceramic particles prior to infiltrating with liquid metal, and wherein the metal alloy is copper alloy (Cu alloy) which is formed with addition of relatively small amounts of Ag and Ni as follows, $Cu—Ag_X—Ni_Y$ where X=1 to 4 wt % and Y=0.5 to 1.5 wt %.

8. The circuit breaker of claim 7, wherein the ceramic particles are tungsten carbide (WC).

9. The circuit breaker of claim 7, wherein 30 wt % of metal alloy is a conductor metal and 70 wt % is the ceramic particles.

10. The circuit breaker of claim 7, wherein when considering weight proportions of the metal alloy/ceramic particles the metal alloy portion contents are 30 to 50 wt %.

* * * * *